US006810685B2

(12) United States Patent
Esposito, Jr.

(10) Patent No.: US 6,810,685 B2
(45) Date of Patent: Nov. 2, 2004

(54) JEWELRY FASTENER ASSEMBLY

(75) Inventor: Joseph R. Esposito, Jr., Providence, RI (US)

(73) Assignee: J.R. Esposito Designs, Inc., Providence, RI (US)

( * ) Notice: Subject to any disclaimer, the term of this patent is extended or adjusted under 35 U.S.C. 154(b) by 0 days.

(21) Appl. No.: 09/735,957

(22) Filed: Dec. 13, 2000

(65) Prior Publication Data

US 2002/0083737 A1 Jul. 4, 2002

(51) Int. Cl.[7] ..... A44C 25/00

(52) U.S. Cl. ..... 63/39; 63/40; 63/3.1; 63/15.3; 63/23; 63/29.1

(58) Field of Search ..... 63/1.11, 1.16, 63/1.17, 3, 3.1, 3.2, 23, 29.1, 39, 40, 15.3; 24/574.1, 586.11, 587.11, DIG. 41

(56) References Cited

U.S. PATENT DOCUMENTS

| | | | | | |
|---|---|---|---|---|---|
| 469,449 | A | * | 2/1892 | Kelley | 59/91 |
| 904,566 | A | * | 11/1908 | Schwab | 132/145 |
| 1,574,962 | A | * | 3/1926 | Fischer | 63/1.15 |
| 2,316,225 | A | * | 4/1943 | De De Hoffmann et al. | 63/29.1 |
| 2,942,318 | A | * | 6/1960 | Charles | 63/39 |
| 3,122,900 | A | | 3/1964 | Beghetto, Jr. | |
| 3,192,738 | A | * | 7/1965 | Charles et al. | 63/39 |
| 3,208,238 | A | | 9/1965 | Spitzer | |
| 3,357,204 | A | * | 12/1967 | Davis | 63/39 |
| 3,830,080 | A | | 8/1974 | Friedlander | |
| 4,406,296 | A | * | 9/1983 | Wexler et al. | 132/148 |
| 4,551,993 | A | | 11/1985 | Nagahori | |
| 4,770,008 | A | * | 9/1988 | Yamaura | 63/3 |
| 5,022,237 | A | | 6/1991 | Monderer et al. | |
| 5,138,855 | A | | 8/1992 | Faris | |
| 5,410,784 | A | * | 5/1995 | Katz | 24/587.1 |
| 5,486,127 | A | * | 1/1996 | Wolfe | 446/120 |
| 5,579,819 | A | * | 12/1996 | Hung et al. | 160/178.1 R |
| 5,592,835 | A | * | 1/1997 | Herr | 63/4 |
| 5,689,867 | A | * | 11/1997 | Katz | 24/587.1 |
| 5,782,107 | A | | 7/1998 | Glanz | |
| 6,401,488 | B1 | * | 6/2002 | Cousin et al. | 63/3 |
| 6,729,159 | B2 | * | 5/2004 | Rose | 63/29.1 |

FOREIGN PATENT DOCUMENTS

| | | | | |
|---|---|---|---|---|
| DE | 29618292 | * | 2/1997 | A44C/9/00 |

OTHER PUBLICATIONS

Fun–4kidz auction listing, Pop'N Magic Fashion Bead Kit, undated, as posted on ebay.com May 19, 2004, 4 pages.*

S & S worldwide, Pop'N Magic Beads Activity Packs, from www/ssww.com/store/ undated, 1 page.*

Fpapijoe 2002 auction listing, 1400 snap–it beads asst colors, undated, as posted on ebay.com May 22, 2004, 5 pages.*

Pretty Snazzy, N274—Red, White, Blue, Black Pop Beads Necklace, undated, from www/pages.prettysnazzy.com/8076/PictPage/1922001138.html, 2 pages.*

* cited by examiner

*Primary Examiner*—Robert J. Sandy
*Assistant Examiner*—Katherine Mitchell
(74) *Attorney, Agent, or Firm*—Salter & Michaelson

(57) ABSTRACT

A jewelry fastener assembly which can be utilized to support a pendant or enhancer. The jewelry fastener assembly includes a clasp for securing an article of jewelry on a user, and a coupling device for releasably securing the enhancer to the clasp. The clasp preferably includes a first and second member supported on opposite ends of the article of jewelry, the first and second members being configured to releasably engage each other in a first, engaged position where the enhancer is not utilized. The coupling device preferably includes a third and a fourth member supported on the sides of the enhancer. The third member is configured to releasably engage the first member of the clasp, and the fourth member is configured to releasably engage the second member of the clasp in a second, engaged position where the enhancer is supported between the clasp and releasably secured thereto.

12 Claims, 5 Drawing Sheets

JEWELRY FASTENER ASSEMBLY

TECHNICAL FIELD

The invention relates generally to a jewelry fastener assembly and, more specifically to an improved fastener for a necklace and jewelry enhancer or pendant.

BACKGROUND OF RELATED ART

The use of pendants and other enhancers with necklaces, bracelets, and the like as items of adornment is well known in the art. Such enhancers generally include a ring or loop at an upper end thereof, which is slipped over one end of the necklace or bracelet, or is otherwise hung from the necklace or bracelet. The necklace or bracelet generally includes an elongated member, such as a chain, having a clasp in order to secure one end of the chain to the other end, around the neck or wrist of the user.

In use, enhancers which freely slide on a chain may become displaced and not hang in a proper position on the user. For example, in a necklace the enhancer may not lie flat and centered on the front of the user's neck, and the clasp may likewise become displaced and move toward the front of the user's neck instead of remaining hidden behind the neck of the user. Conventional clasps are generally intended to serve a functional purpose and are not intended to provide adornment. Exceptions are those clasps which themselves are decorative in nature. However, such clasps are generally not used in combination with an enhancer since the clasp provides adornment to the chain. Two of the more popular style clasps are spring-ring style clasps and lobster claw clasps. Each of these clasps includes a loop portion supported on one end of the chain and either a spring-ring or a lobster-claw shaped clasp member which releasably engages the loop portion. Other style clasps are also known in the art, for example U.S. Pat. No. 3,830,080 to Friedlander discloses a clasp which includes a male and a female portion that are snapped into engagement during use. However, with any of the aforementioned conventional style clasps the enhancer may still freely slide on a chain and become displaced during use.

Accordingly, there is needed in the art an improved device for reliably and securely positioning an enhancer from a piece of jewelry such as a necklace or bracelet.

SUMMARY

One object of the present invention is to provide an improved jewelry fastener assembly which can be utilized to support a pendant or enhancer. The jewelry fastener assembly includes a clasp for securing an article of jewelry on a user, and a coupling device for releasably securing the enhancer to the clasp. The clasp preferably includes a first and second member supported on opposite ends of the article of jewelry, the first and second members being configured to releasably engage each other in a first, engaged position where the enhancer is not utilized. The coupling device preferably includes a third and a fourth member supported on sides of the enhancer. The third member is configured to releasably engage the first member of the clasp, and the fourth member is configured to releasably engage the second member of the clasp in a second, engaged position where the enhancer is supported between the clasp and releasably secured thereto. In one embodiment, the first and second members of the clasp preferably include a male, snap-style projection which is sized to be matingly received within a corresponding female receptacle in the first, engaged position. Likewise, the third and fourth members of the coupling device preferably include a male, snap-style projection and a female receptacle which are configured and sized to be matingly received within the corresponding female and male elements of the clasp in the second, engaged position where the enhancer is supported by the clasp.

Releasably securing and supporting the enhancer between the ends of the article of jewelry allows the enhancer to substantially remain in its proper position on the user since it is not freely slidable on the article of jewelry.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENT

A jewelry fastener assembly 10 for securing an ornamental enhancer 11 to an article of jewelry, is illustrated in FIGS. 1–8. As used herein, the term "jewelry" refers to any type or style of jewelry which utilizes a fastener to attach one end of the article of jewelry to a second end of the article of jewelry. Also, as used herein the term "enhancer" refers to any ornamental item which is suspended and supported by the article of jewelry (for example a pendant or charm). In the description which follows the article of jewelry is described as a necklace, however, this is not intended to limit the scope of the application since the fastener assembly may find use with other types of jewelry which utilize an ornamental enhancer, such as a bracelet.

Figure 1:
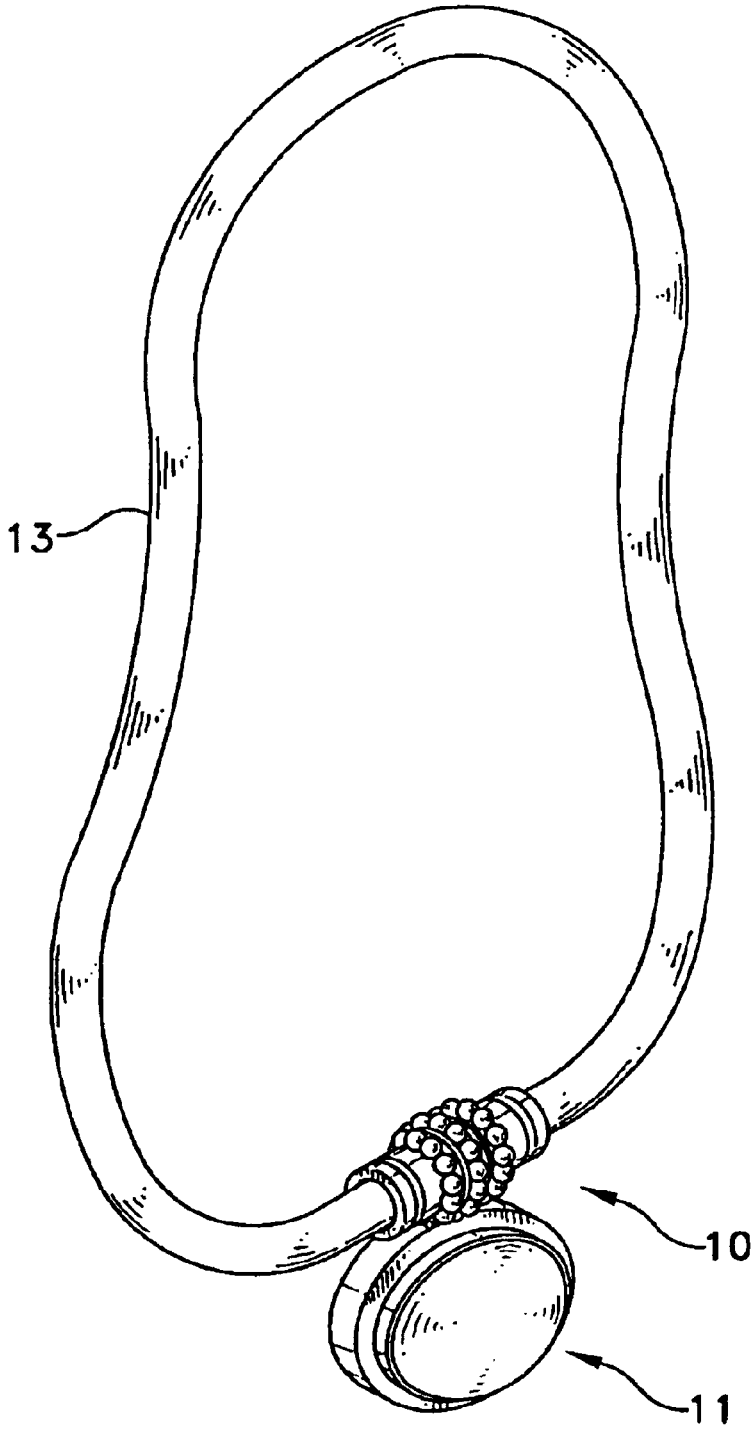
FIG. 1 is a perspective view of the jewelry fastener assembly, including an enhancer supported in a closed position between the ends of a necklace according to one illustrative embodiment of the present invention.
Figure 2:
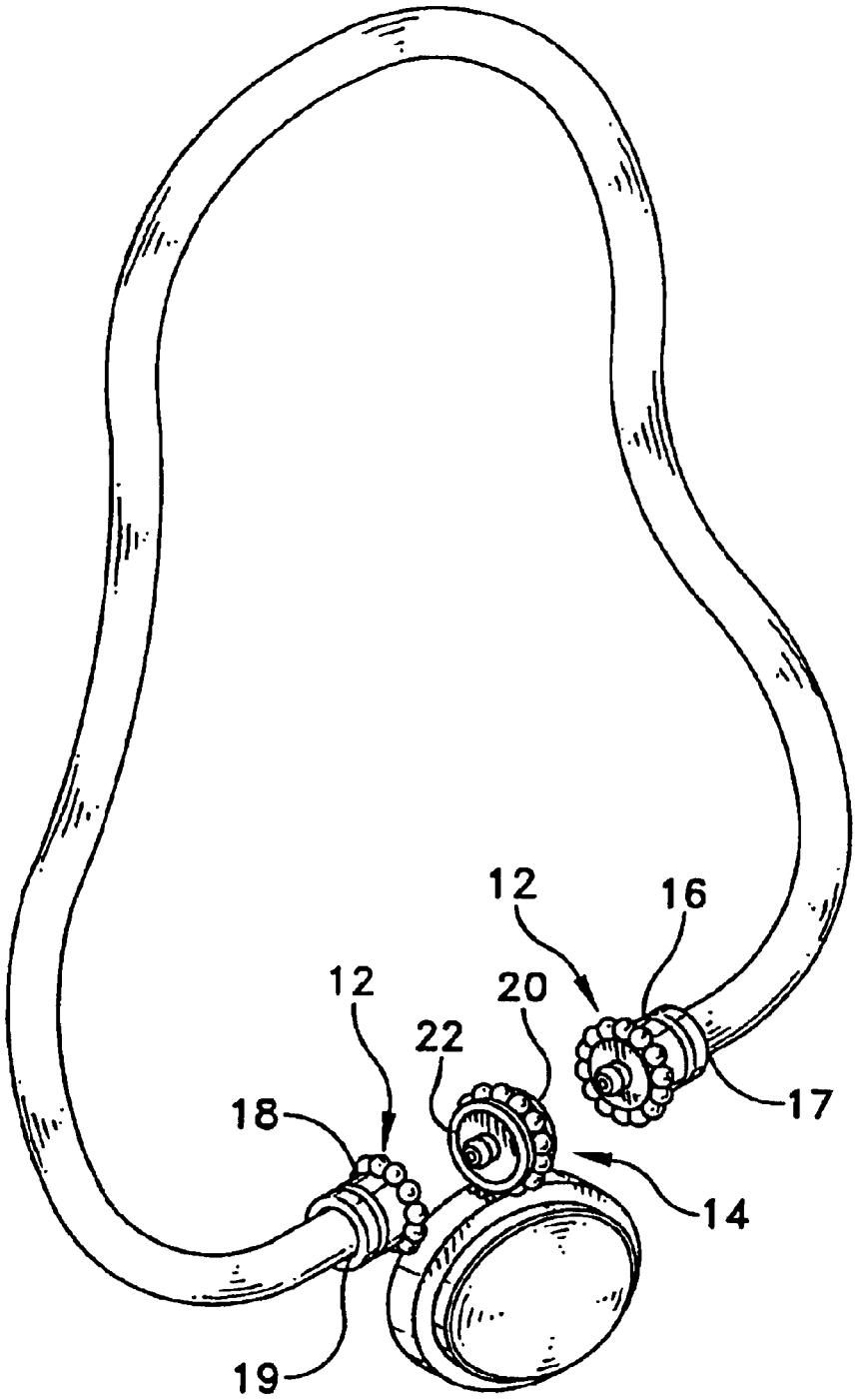
FIG. 2 is a perspective view of the jewelry fastener assembly of FIG. 1 in a non-engaged, open position.
Figure 8:
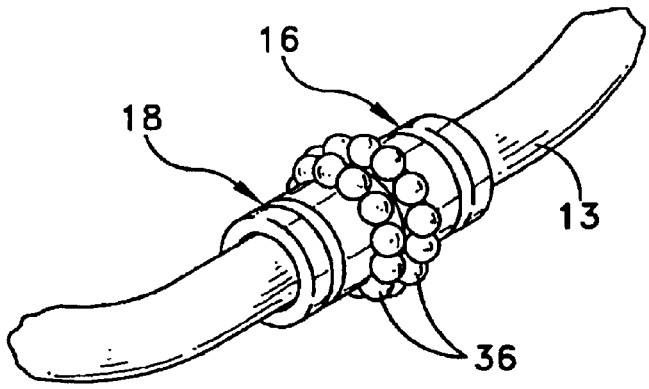
FIG. 8 is a perspective view of the ends of the piece of jewelry forming part of the fastener assembly of the embodiment of FIG. 1, in a closed position without the enhancer.

In the present embodiment, the jewelry fastener assembly 10 includes a clasp 12 for securing the necklace 13 around the neck of a user, and a coupling device 14 for releasably securing the enhancer 11 to the necklace. The clasp 12 preferably includes a first member 16 and a second member 18 supported on opposite ends 17, 19 of the necklace, the first and second members being configured to releasably engage each other in a first, engaged position where the enhancer is not supported by the necklace (FIG. 8). The coupling device 14 preferably includes a third member 20 and a fourth member 22 supported on sides 24, 26 of the enhancer 11. The third member 20 is configured to releasably engage the first member 16, and the fourth member 22 is configured to releasably engage the second member 18 in a second, engaged position where the enhancer is supported by the necklace and releasably secured thereto (FIG. 1).

Figure 3:
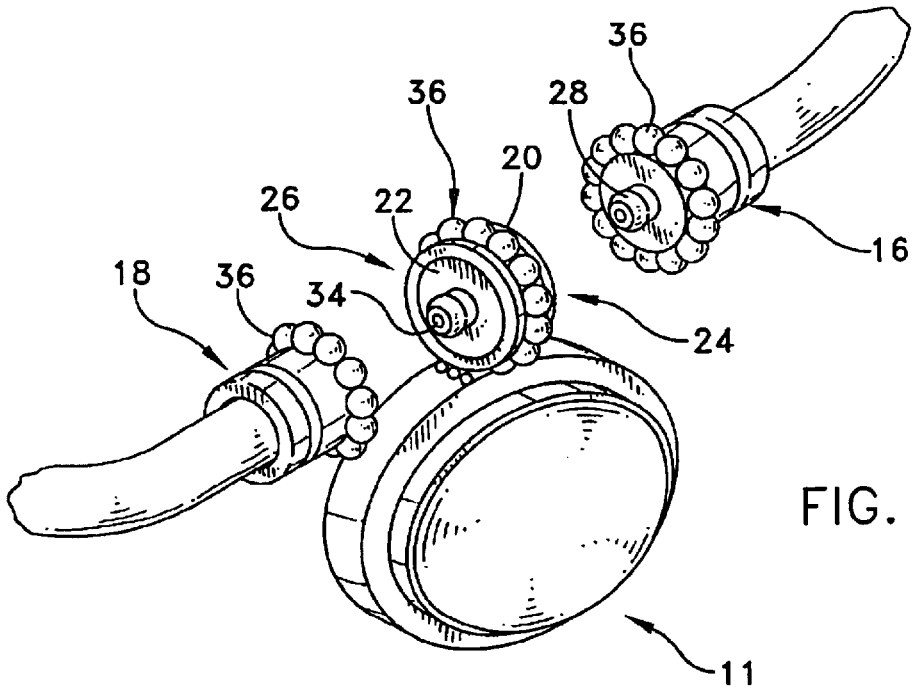
FIG. 3 is an enlarged perspective view of the jewelry fastener assembly of FIG. 2 in the open position and showing a pair of projections.
Figure 4:
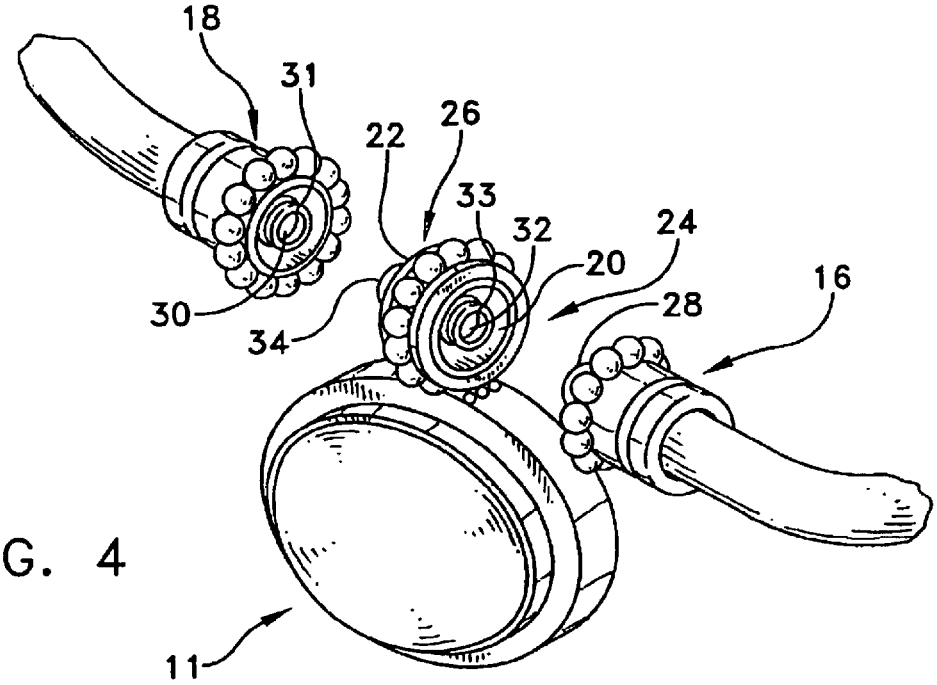
FIG. 4 is an enlarged perspective view of the jewelry fastener assembly of FIG. 2 in the open position and showing a pair of receptacles.
Figure 5:
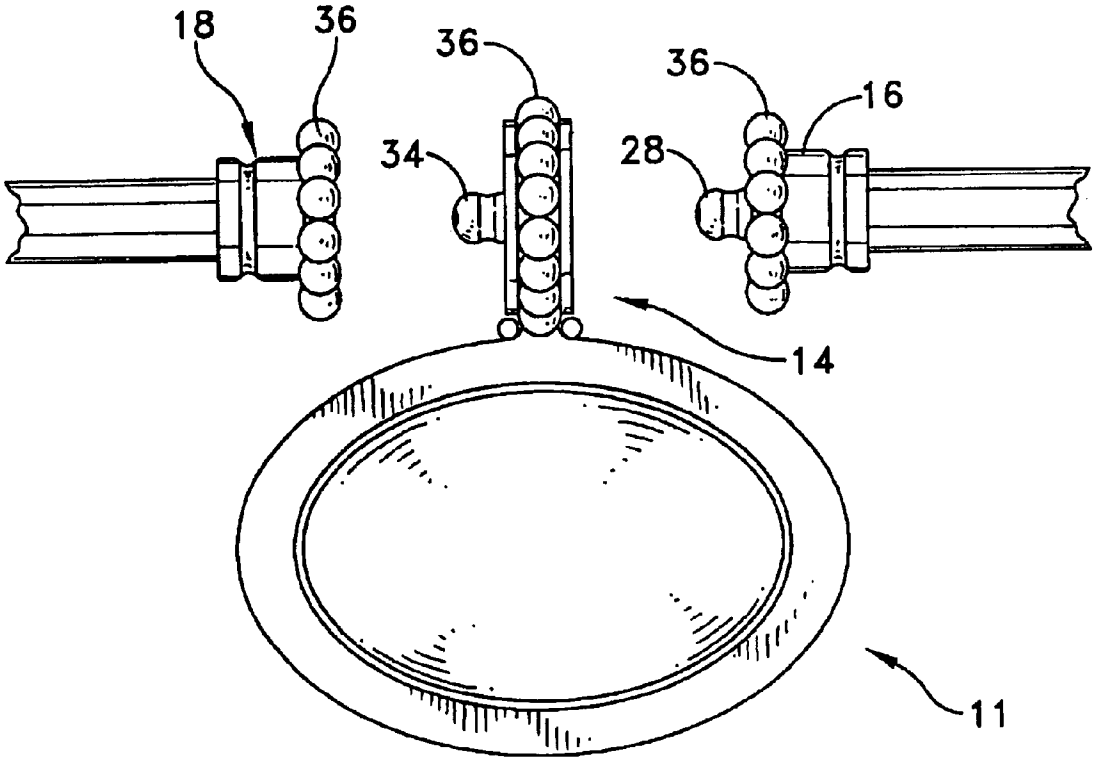
FIG. 5 is an enlarged front plan view of the jewelry fastener assembly of FIG. 2 in the open position.
Figure 6:
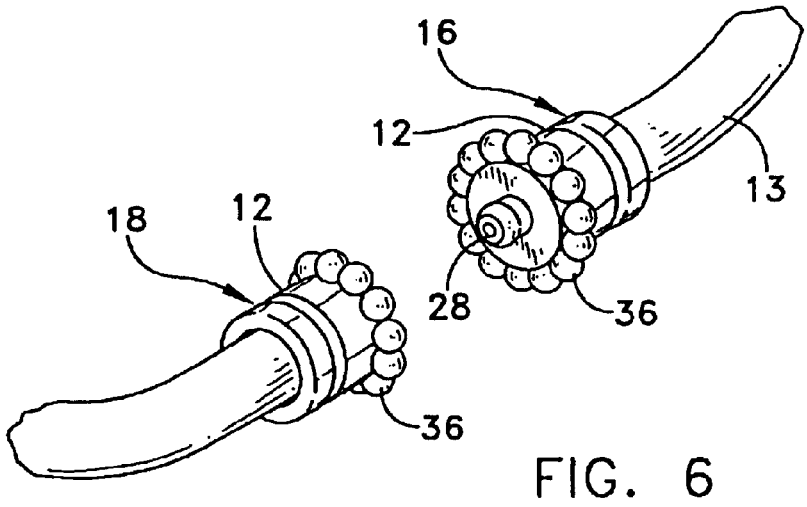
FIG. 6 is a perspective view of the ends of the piece of jewelry forming part of the fastener assembly of the embodiment of FIG. 1, in an open position without the enhancer.
Figure 7:
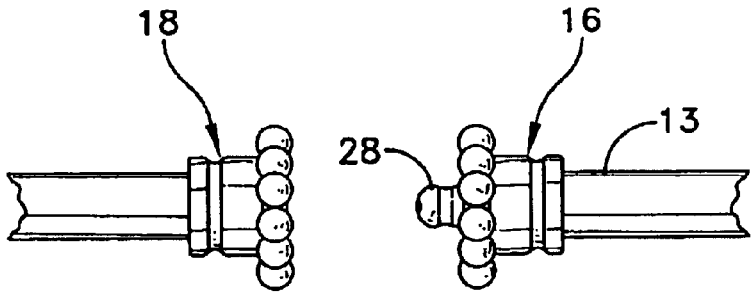
FIG. 7 is a front plan view of the ends of the piece of jewelry forming part of the fastener assembly of the embodiment of FIG. 1, in an open position without the enhancer.

Referring now to FIGS. 3–4, in the present embodiment the first member 16 preferably includes a male, snap-style projection 28 which is sized to be matingly received within a corresponding female receptacle 30 of the second member in the first, engaged position (FIG. 8). The female receptacle 30 may include an aperture bounded by a raised wall 31 and is designed to securely maintain the projection 28 therein until released by a sufficient force supplied by a user. The male, snap-style projection and female receptacle together form a conventional-style snap, such snaps being utilized, for example with clothing. The third member 20 also preferably includes a female receptacle 32 bounded by wall 33, the receptacle being sized to matingly receive the male snap-style projection 28 of the first member 16 in the second, engaged position (FIG. 1). Likewise, the fourth member 22 preferably includes a male, snap-style projection 34 sized to be matingly received within the female receptacle 30 of the second member 18 in the second, engaged position. In this manner, the user may wear the necklace without the enhancer by engaging the first member 16 with the second member 18, or may choose to wear the necklace with the enhancer by releasably engaging the first and second members of the necklace clasp with the third and fourth members of the enhancer coupling device, respectively. The clasp and the coupling device may also be partially concealed by an ornamental edge 36, for example a beaded edge, in order to provide a continuous appearance between the enhancer and the necklace.

The clasp, coupling device, and necklace may be made from any suitable material, or combinations thereof, as would be known in the art. In the present embodiment, the clasp, coupling device and necklace are each made from metal and alloys thereof. However, plastic, or other synthetic materials may be utilized and the clasp, coupling device and necklace (or other article of jewelry) need not be made from the same material. Likewise, the enhancer may be made of any suitable material, including gemstones (both natural and synthetic), precious and non-precious metals, and/or plastic materials as would be known to those of skill in the art. A variety of different style and/or types of enhancers may be provided such that the enhancers may be exchanged, each enhancer having a coupling device which matingly engages the clasp of the necklace as described herein above.

Use of the fastener assembly 10 will now be described with reference to the drawings.

In use, the necklace and enhancer may be releasably secured around the neck of a user by inserting the projection of the first member into the receptacle of the third member and the projection of the fourth member into the receptacle of the second member. In this manner, the enhancer 11 is releasably secured between the ends 17, 19 of the necklace 13 such that the enhancer hangs from the necklace. By securing the enhancer between the ends of the necklace, the enhancer is not free to slide on the necklace as with the prior art, and is more likely to remain in its proper position on the user. The proper positioning is also enabled by the combined weight of the enhancer and clasp which tends to position the enhancer centered on the front of the user's neck. In addition, because the clasp of the necklace is secured to the enhancer, the clasp is less likely to be displaced. If the user desires, the enhancer coupling device may be disengaged from the necklace clasp in order to remove the enhancer. To disengage, the user simply applies a force sufficient to remove the male projections of the first and third members from the female receptacles of the fourth and second members, respectively. Once removed, another enhancer may be utilized, or the necklace may be worn alone by the user inserting the projection of the first member into the receptacle of the second member as shown in FIG. 8. The fastener assembly 10 reliably and securely positions an enhancer from a piece of jewelry such as a necklace or bracelet, and allows the enhancer to be readily removed so that jewelry can be utilized without the enhancer.

It will be understood that various modifications may be made to the embodiment disclosed herein. For example, the article of jewelry need not be a necklace, the size, dimensions and geometric configuration of the pendant and necklace may be varied, and various types of materials may be utilized. In addition, the clasp and the coupling device need not be the exact configuration as shown and may be varied as would be known to those of skill in the art (for example, they may be magnetized). Therefore, the above description should not be construed as limiting, but merely as exemplifications of a preferred embodiment. Those skilled in the art will envision other modifications within the scope, spirit and intent of the invention.

What is claimed is:

1. A jewelry fastener assembly comprising:

a clasp including a first member supported on one end of an article of jewelry and a second member supported on an opposite end of the article of jewelry, one of the first and second members including a male, snap-style projection and the other of the first and second members including a female receptacle constructed and dimensioned to matingly receive the male, snap-style projection there in the first and second members being constructed and arranged to releasably engage each other in a first, engaged position;

a coupling device including a third member supported on one side of the coupling device and constructed and arranged to releasably engage the first member, a fourth member supported on another side of the coupling device and constructed and arranged to releasably engage the second member in a second, engaged position, wherein one of the third and fourth members includes a male, snap-style projection constructed and arranged to fit within the female receptacle of the corresponding first or second member, and the other of the third and fourth members includes a female receptacle configured and dimensioned to matingly receive the projection of the first or second member therein;

each of said female receptacles including an aperture bounded by a raised wall;

an ornamental enhancer including an upper edge constructed and arranged to support the coupling device; and wherein in the second engaged position the coupling device is disposed between the first member and the second member, such that the third member of the coupling device is releasably engaged with the first member of the article of jewelry and the fourth member of the coupling device is releasably engaged with the second member of the article of jewelry, and the enhancer is supported from the coupling device such that it hangs below the coupling device.

2. The jewelry fastener assembly of claim 1, wherein the article of jewelry is a necklace.

3. The jewelry fastener assembly of claim 1, wherein the article of jewelry is a bracelet.

4. A jewelry fastener assembly comprising:

a clasp including a first member supported on one end of an article of jewelry and a second member supported on an opposite end of the article of jewelry, one of the first and second members including a male, snap-style projection and the other of the first and second members including a female receptacle constructed and dimensioned to matingly receive the male, snap-style projection therein, the first and second members being constructed and arranged to releasably engage each other in a first, engaged position;

a coupling device including:

a third member supported on one side of the coupling device and constructed and arranged to releasably engage the first member;

a fourth member supported on an other side of the coupling device and constructed and arranged to releasably engage the second member in a second, engaged position, wherein one of the third and fourth members includes a male, snap-style projection constructed and arranged to fit within the female receptacle of the corresponding first or second member, and the other of the third and fourth members includes a female receptacle configured and dimensioned to matingly receive the projection of the first or second member therein;

each of said female receptacles including an aperture bounded by a raised wall;

an ornamental enhancer including an upper edge constructed and arranged to support the coupling device; and wherein in the second engaged position the coupling device is supported by the first member and the second member of the clasp, and is releasably engaged therewith, and the enhancer is supported from the coupling device such that it hangs below the coupling device.

5. The jewelry fastener assembly of claim 4, further comprising an ornamental edge constructed and arranged to at least partially conceal the clasp.

6. The jewelry fastener assembly of claim 4, further comprising an ornamental edge constructed and arranged to at least partially conceal the coupling device.

7. The jewelry fastener assembly of claim 4, further comprising an ornamental edge constructed and arranged to at least partially conceal the clasp and an ornamental edge constructed and arranged to at least partially conceal the coupling device.

8. The jewelry fastener assembly of claim 4, wherein the article of jewelry is a necklace.

9. The jewelry fastener assembly of claim 4, wherein the article of jewelry is a bracelet.

10. A jewelry fastener assembly comprising:

a first male snap-style projection supported on one end of an article of jewelry;

a first female receptacle constructed and arranged to receive the first male snap-style projection in a closed position and supported on an opposite end of the article of jewelry;

a coupling device including a second male snap style projection supported on one side thereof and constructed and arranged to releasably engage the female receptacle of the article of jewelry, a second female receptacle supported on an other side of the coupling device and having an aperture therein constructed and arranged to releasably engage the first male snap-style projection of the article of jewelry;

each of said female receptacles including an aperture bounded by a raised wall;

an ornamental enhancer including an upper edge constructed and arranged to support the coupling device; and wherein in a first secured position the first male snap-style projection is inserted within the first female receptacle such that the piece of jewelry may be worn by a user, and wherein in a second secured position the coupling device is disposed between the one end of the piece of jewelry and the other end of the piece of jewelry and the first male snap-style projection is secured within the second female receptacle and the second male snap-style projection is secured within the first female receptacle, and the enhancer is supported from the coupling device such that it hangs below the coupling device.

11. The jewelry fastener assembly of claim 10, wherein the article of jewelry is a necklace.

12. The jewelry fastener assembly of claim 10 wherein the article of jewelry is a bracelet.

* * * * *